United States Patent [19]

Suska

[11] Patent Number: 4,823,636

[45] Date of Patent: Apr. 25, 1989

[54] WRENCHABLE C-CLAMP

[76] Inventor: Charles R. Suska, R.R. 1 - Box 14, Roxbury, Conn. 06783

[21] Appl. No.: 43,371

[22] Filed: Apr. 28, 1987

[51] Int. Cl.[4] ..... B25B 5/06; B25B 27/00

[52] U.S. Cl. ..... 24/569; 24/514; 81/10; 269/249; 403/22

[58] Field of Search ..... 24/569, 486, 495, 514, 24/522, 525, 535; 403/22; 285/39; 81/10; 269/249

[56] References Cited

U.S. PATENT DOCUMENTS

| | | | |
|---|---|---|---|
| 855,989 | 6/1907 | Shear et al. | 24/525 |
| 874,233 | 12/1907 | Parsons | 81/10 |
| 920,386 | 5/1909 | Parsons | 81/10 |
| 1,281,928 | 10/1918 | Fifeld | 81/10 |
| 1,973,238 | 9/1934 | Walter . | |
| 2,100,918 | 11/1937 | Ringman | 24/486 |
| 2,324,803 | 7/1943 | Snyder | 24/569 |
| 2,433,324 | 12/1947 | Rogers | 24/486 |
| 2,778,393 | 1/1957 | Golasowski . | |
| 3,934,316 | 1/1976 | Driscoll | 24/486 |
| 4,157,195 | 6/1979 | Costanzo et al. | 285/198 |
| 4,607,829 | 8/1986 | Suska . | |
| 4,617,703 | 10/1986 | Schaeffer | 403/22 |
| 4,649,614 | 3/1987 | Lund | 24/514 |

FOREIGN PATENT DOCUMENTS

| | | | |
|---|---|---|---|
| 1108271 | 1/1956 | France | 24/525 |
| 0405967 | 7/1966 | Switzerland | 24/569 |
| 2126271 | 3/1984 | United Kingdom . | |

OTHER PUBLICATIONS

Adjustable Clamp Company catalog No. 90 (11/81).

*Primary Examiner*—Victor N. Sakran
*Attorney, Agent, or Firm*—Brumbaugh, Graves, Donohue & Raymond

[57] ABSTRACT

A wrenchable C-clamp is formed with a hexagonal portion coaxial with a clamping screw and sized to fit standard open end and box wrenches. A user can apply a wrench to the wrenchable portion to hold the C-clamp in a desired position while a clamping screw is actuated.

4 Claims, 1 Drawing Sheet

WRENCHABLE C-CLAMP

BACKGROUND OF THE INVENTION

Conventional C-clamps have been held against rotation and in a desired position relative to a workpiece being clamped by any of several expedients, when turning their clamping screws. These expedients have included grasping the C-frames by hand, allowing the C-frames to rotate until making contact with the workpieces, or providing blocks or wedges between the C-frames and stationary objects as may be available at the immediate work-site. The rotative torques to be resisted by these expedients are dependent upon the clamping forces desired against the workpieces and the amount of friction developed between the fixed clamping surfaces and the workpieces. The resultant C-frame rotative torques are, in some instances, of considerable magnitudes, especially when large size or heavy duty C-clamps are used, as such C-clamps employ clamping screws actuated by sliding cross-bars or by wrenches to facilitate the application of high tightening or loosening torques. To resist such rotative torques by grasping the C-frames by hand, or by other expedients, can be unsafe, inconvenient and possibly damaging to the workpieces.

Although C-clamps have been used for decades, the difficulty of holding them while tightening or loosening their clamping screws, and the attendant risks of injuries to hands and workpieces, has been accepted as inherent by those skilled in the art. Prior art C-clamps have not provided effective means for eliminating either this difficulty or the risks attendant thereto. The present invention described hereinafter provides a simple, user option for eliminating both the difficulty and the risks.

SUMMARY OF THE INVENTION

The present invention is directed to an improved C-clamp that can be used more safely, more conveniently and more effectively.

In particular, the inventive wrenchable C-clamp provides a hexagonal portion coaxial with a clamping screw and sized to fit standard open end and box wrenches. A user can apply a suitable wrench to the hexagonal portion to hold the C-clamp in a desired position while a clamping screw is actuated. This structure affords advantages, including greater safety and more convenient application of higher torques to the clamping screws of C-clamps, all such benefits being achieved with little if any increased manufacturing costs for the wrenchable C-clamps.

DESCRIPTION OF EXEMPLARY EMBODIMENTS

Figure 1:
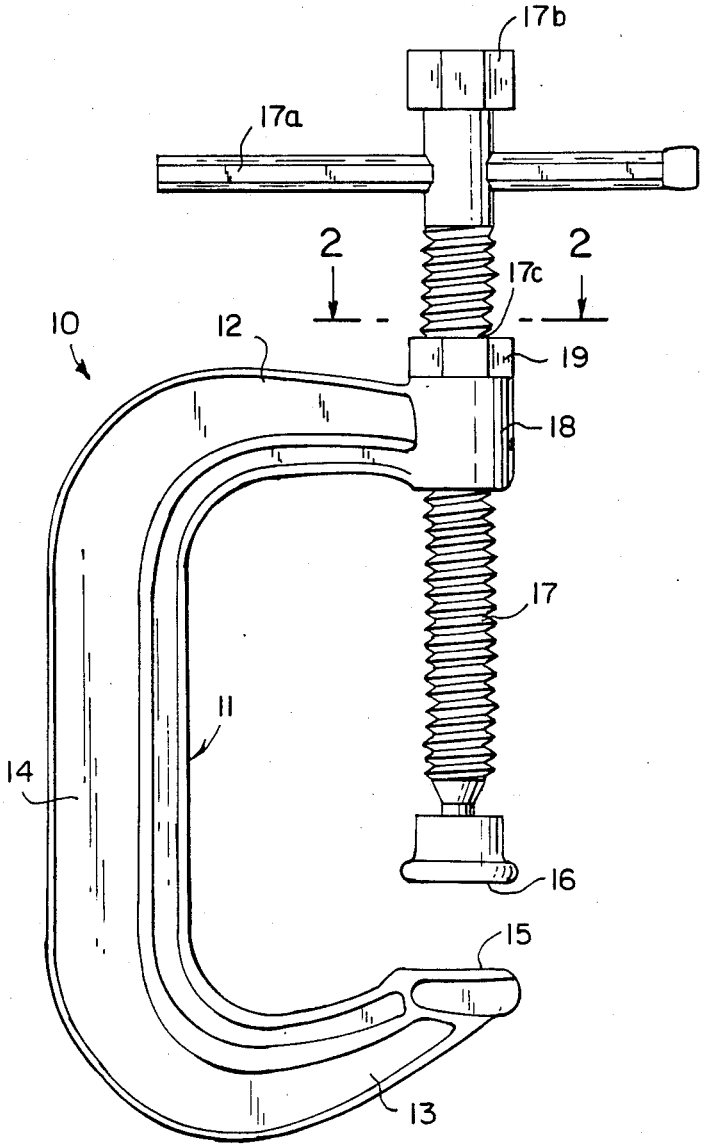
FIG. 1 a side view of the inventive C-clamp.

Referring to the invention in greater detail, and as illustrated in FIG. 1, a C-clamp 10 is formed by a C-frame 11 and a clamping screw 17. C-frame 11 includes arms 12 and 13 joined by a shank 14. The C-frame may be ribbed, flanged, flat-sided or of other cross-section, as is well known in the art. A fixed clamping surface 15 is provided on the arm 13. A clamping screw 17 includes a movable clamping surface 16 pivotally carried by a threaded rod that has a suitable actuating device on the other end. The actuating device is a sliding cross-bar **17*a* or a wrenchable head 17*b*, or both, the latter being for engagement with a standard size wrench. If both are used, the cross-bar 17*a*** may be removable.

The clamping screw 17 passes through a tapped hole **17*c* in a frame-portion 18 of the contiguous arm 12. A wrenchable portion 19 extends toward the outer end of the clamping screw 17 and is formed in the shape of a hexagonal nut coaxial with the clamping screw 17. Note that the cross-bar 17*a* may be removable to permit a box wrench to be applied to the hexagonal portion 19**.

Figure 3:
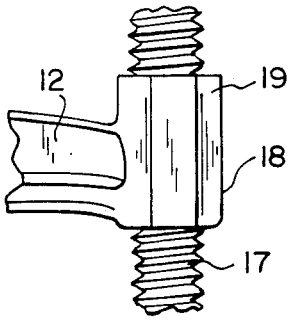
FIG. 3 is a partial side view of a modified form of the inventive clamp.

Referring to FIG. 3, the wrenchable portion is extended throughout the length of the frame portion 18 to facilitate use of standard size open end wrenches to hold the C-clamp.

The hexagonal shape of the wrenchable portion 19, in addition to the importance of its exact mating with standard open end and box wrenches, enables the wrenches to be properly positioned at a desired point in the 360° circumference of the clamp. A lesser number of flats would severely restrict the circumferential position of the wrench holding the C-clamp.

In the exemplary embodiments shown in FIGS. 1 and 3, the C-frame is of cast or forged ferrous material with the hexagonal wrenchable portion 19 expanding outwardly and extending from contiguous arm 12 toward the actuating end **17*b* of the screw 17 to an extent approximately equal to the height of a conventional nut of a thread size that would properly fit the threaded portion of the clamping screw 17**.

While the head **17*b* is shown as the same size as the portion 19, it may be desirable to use a smaller size nut 17*b* to facilitate access to the portion 19 and to enable two different wrenches to be used on the two nut portions 17*b* and 19**.

The wrenchable portion 19 extending toward the end of the clamping screw has six parallel flats arranged in a regular, equal-side hexagonal configuration. The side-to-side width across these flats on the portion 19 is preferably the same as the side-to-side width across flats on a conventional hexagonal nut of a thread size that would mate with the threaded portion of the clamping screw 17. As C-clamps vary over a considerable range of commercial sizes, such as 1 to 18 inches throat capacity, their clamping screw diameters change commensurately. The above-stated design criterion therefore assures that the size of the hexagonal portion 19 in the exemplary embodiment bears the same relationship to the thread size of the clamping screw 17 as would a mating nut, and in this manner the size of the hexagonal extension 19 is commensurate with the size of the C-clamp.

The wrenchable portion 19 can be precisely mated by a standard size open end or box type wrench. The extension of portion 19 beyond arm 12 provides for an effective engagement of a box type wrench.

Figure 4:
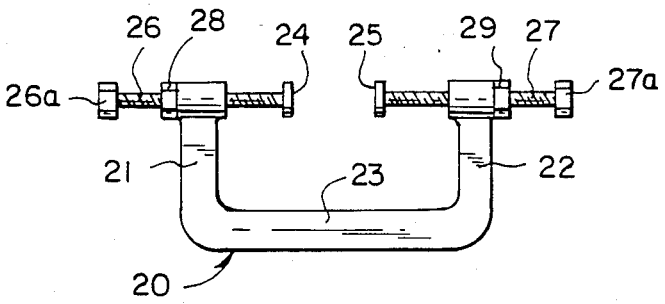
FIG. 4 is a side view of another embodiment of the wrenchable C-clamp.

FIG. 4 illustrates another embodiment of the inventive C-clamp in which a C-frame 20 includes arms 21 and 22 joined by a shank 23. Two adjustable clamping surfaces 24 and 25 are pivotally carried by threaded rods or clamping screws 26 and 27 having flatted heads **26*a* and 27*a*, or sliding cross-bars (not shown), for actuating the rods. Hexagonal wrenchable portions 28 and 29 is threaded to receive the clamping screws 26 and 27. As discussed in connection with FIG. 1, the hexagonal portions 28 and 29** are sized to fit standard open end wrenches and box wrenches.

Thus it will be seen that, in the exemplary embodiments described, the C-clamp frames can be easily and effectively engaged by readily available standard size wrenches that are commensurably sized to the C-clamps selected.

Figure 2:
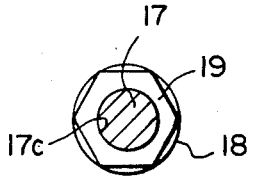
FIG. 2 is a cross-section of FIG. 1 taken along the view line 2—2 looking in the direction of the arrows.

The operation of the inventive C-clamps of FIGS. 1–3 are simple and readily understood. Workpieces to be clamped are placed within the throat of the C-frame 11, between the fixed surface 15 and the movable surface 16, in the same manner as conventional C-clamps. The C-frame 11 may be positioned where desired on the workpieces while the clamping screw is finger-tightened sufficiently to hold the C-clamp in the desired position on the workpieces. Then, a standard size wrench is applied to the hexagonal portion 19 while the clamping screw 17 is given its final tightening by means of the bar 17*a* or head 17*b*.

The wrench that engages the wrenchable portion 19 can be placed at the mot desirable convenient point on a 360° circumference due to the hexagonal configuration. The wrench not only provides an improved handgrip to prevent the C-clamp from moving while the clamping screw is tightened to the full extent desired, but the wrench removes the user's hand from close proximity to the C-clamp to a safer position. The standard wrench can also prevent the C-clamp from making undesired and damaging contact with the workpieces. The wrench offers more effective means for applying greater reactive torque to the C-clamp than can be achieved by direct hand grasp on the C-clamp. While holding the wrench on the C-clamp, the user can conveniently apply torque by hand to the clamping screw's cross-bar 17*a* or by wrench to the clamping screw's wrenchable head 17*b*, depending on which style of actuating device is furnished on the clamping screw. Of course both may be provided.

A wrench applied to the hexagonal portion 19 accomplishes the same advantages when the clamping screw is loosened as when the screw is tightened.

It will be understood that operation of the C-clamp of FIG. 4 is similar to that described in connection with FIG. 1.

The wrenchable C-clamp of the invention presents the user with a portion of the frame that receives a wrench accessibly and effectively. The wrench allows the user's hand to be safely removed from the C-clamp while giving the user greater leverage for better clamping. The disclosed design criterion assures appropriate matching of standard open and box wrench sizes to C-clamp size, with little if any change in manufacturing cost to achieve the inventive improvement.

While the invention has been described with reference to specific embodiments, it will be understood that various changes and modifications may be made within the scope of the invention which is defined in the appended claims.

I claim:

1. A C-clamp comprising a generally C-shaped frame formed by a pair of arms joined by a shank, a clamping screw having actuating means at its outer end and threadably engaging a threaded hole through one arm of same frame, said one arm having a hexagonal wrenchable potion thereon coaxial with said clamping screw, said hexagonal portion being sized to fit standard open end and box wrenches and extending toward the outer end of the clamping screw and capable of receiving torque applied thereto by a standard size open end or box wrench, whereby the C-clamp can be effectively and safely held against rotation by a chosen one of said wrenches while clamping forces are applied by rotation of the clamping screw.

2. A C-clamp as defined in claim 1, wherein the hexagonal portion extends from the outer side of the one arm.

3. A C-clamp as defined in claim 1, wherein the hexagonal portion extends throughout the length of the threaded hole.

4. A C-clamp as defined in claims 1, 2, or 3, wherein a second clamping screw having actuating means at its outer end is threadably carried by a threaded hole in the other of said pair of arms, a second hexagonal wrenchable portion extending toward the outer end of the second clamping screw to enable a standard size box wrench to be applied to the second hexagonal portion, the second hexagonal portion being sized to fit standard open end and box wrenches.

* * * * *